United States Patent [19]

Fuchs

[11] Patent Number: 4,537,020

[45] Date of Patent: Aug. 27, 1985

[54] PROCESS AND APPARATUS FOR SPINNING A STAPLE FIBER JOINED TO A PREVIOUSLY SPUN YARN

[75] Inventor: Helmut Fuchs, Linz, Austria

[73] Assignee: Textilmaschinenfabrik Dr. Ernst Fehrer Aktiengesellschaft, Leonding, Austria

[21] Appl. No.: 688,905

[22] Filed: Jan. 4, 1985

[30] Foreign Application Priority Data

Jan. 19, 1984 [AT] Austria ..... 160/84

[51] Int. Cl.[3] ..... D01H 15/02

[52] U.S. Cl. ..... 57/263; 57/401

[58] Field of Search ..... 57/22, 261, 263, 400, 57/401

[56] References Cited

U.S. PATENT DOCUMENTS

| | | | |
|---|---|---|---|
| Re. 31,594 | 6/1984 | Mima | 57/263 X |
| 4,168,601 | 9/1979 | Didek et al. | 57/401 |
| 4,229,935 | 10/1980 | Wain | 57/22 |
| 4,380,892 | 4/1983 | Parker et al. | 57/263 X |
| 4,494,368 | 1/1985 | Mima | 57/263 X |

*Primary Examiner*—Donald Watkins

*Attorney, Agent, or Firm*—Kurt Kelman

[57] ABSTRACT

A yarn joined to a previously spun yarn is spun in friction spinning apparatus which comprises two juxtaposed, closely spaced apart twisting members, which define a triangular space, from which air is sucked. Singled stable fibers supplied to said triangular space are twisted together by said twisting members to form a yarn, which is withdrawn by a withdrawing device. A joint-forming portion of a previously spun yarn is provided in said triangular space in the region in which said fibers are supplied to said space, and said yarn is withdrawn while fibers are supplied to said triangular space so as to contact said joint-forming portion. To provide said previously spun yarn with a joint-forming portion which can satisfactorily be joined to the fibers for the newly spun yarn, the previously spun yarn which has been introduced into the triangular space is untwisted between the twisting members in a portion which is spaced from the rear end of said yarn and the latter is tensioned to detach a rear end portion of said yarn from the untwisted portion of the yarn and is removed from the triangular space before or during the supply of fibers to the triangular space.

15 Claims, 3 Drawing Figures

PROCESS AND APPARATUS FOR SPINNING A STAPLE FIBER JOINED TO A PREVIOUSLY SPUN YARN

BACKGROUND OF THE INVENTION

1. Field of the Invention

This invention relates to a process of spinning a yarn joined to a previously spun yarn in friction spinning apparatus comprising two juxtaposed, closely spaced apart twisting members, which define a generally triangular space, which tapers to a nip and from which air is sucked. Fibers are supplied to said triangular space and are twisted therein to form a yarn, which is withdrawn by suitable withdrawing means. To join the spun yarn to a previously spun yarn, said previously spun yarn is introduced into the triangular space so that a joint-forming portion of said yarn is disposed in the region to which the fibers are supplied and said previously spun yarn is withdrawn while fibers are supplied to said triangular space so as to contact said joint-forming portion. The invention relates also to spinning apparatus by which said process can be carried out.

2. Description of the Prior Art

When it is desired to spin a yarn which is joined to a previously spun yarn, for instance, after a yarn breakage, in friction spinning apparatus comprising two spinning drums defining a generally triangular space, it is known from (EP-A Nos. 0 034 427) to place a cut end of a previously spun yarn into the triangular space and to withdraw said previously spun yarn from said triangular space while singled staple fibers are supplied to the triangular space so as to contact the previously spun yarn in said space. The fibers are then twisted in contact with the previously spun yarn to form a new yarn, which is withdrawn together with the previously spun yarn. That process of spinning a yarn joined to a previously spun yarn has the disadvantage that the joint between the previously spun and new yarns is thicker and must be aftertreated. Besides, the formation of such joints having the same strength as other portions of said yarns cannot be ensured.

It is known from Laid-open German Application No. 32 47 288 that a previously spun yarn may be provided at one end with a thinned-out fiber tuft, which is a spinning rotor of open-end spinning apparatus pemits an improved spinning of a yarn joined to a previously spun yarn. In accordance with that proposal a portion of the previously spun yarn is gripped between two grippers and is untwisted between said grippers in that one gripper is held against rotation and the other gripper, which is mounted to be freely rotatable, is subjected to a tensile force in the direction of the axis of the yarn. Under the action of that tensile force, which is exerted on the rotatably mounted gripper preferably by means of a weight, a yarn is untwisted and that end portion of the yarn which is gripped by the rotatable gripper is detached from the remaining yarn so that the latter is provided at its rear end with a thinned-out fiber tuft having fiber ends spaced along the yarn. New fibers supplied to the spinning rotor can then be joined to said fiber tuft without a formation of an enlarged joint. That known process of spinning a yarn joined to a previously spun yarn has the disadvantage that separate equipment is required to form the fiber tuft so that the expenditure is greatly increased and a relatively long time is required until spinning can be continued after a yarn breakage because in that case the previously spun yarn cannot be introduced into this spinning rotor until it has been provided with a fiber tuft.

SUMMARY OF THE INVENTION

It is an object of the invention to avoid these disadvantages and to provide a process of spinning a yarn joined to a previously spun yarn in friction spinning apparatus comprising two juxtaposed, closely spaced apart twisting members defining a nip, in which process a previously spun yarn is provided with an untwisted fiber tuft without a need for a separate untwisting device.

It is another object of the invention to provide a process of spinning a yarn which is joined to a previously spun yarn at a thinned-out fiber tuft thereof, which is formed in the region in which fibers are supplied which contact said fiber tuft and are subsequently twisted together with said fiber tuft.

In a process of the kind described first hereinbefore, said objects are accomplished in accordance with the invention in that the previously spun yarn placed into the triangular space between the twisting members is untwisted between the twisting members in a portion preceding the rear end of said yarn, the previously spun yarn is tensioned to detach a rear end portion thereof of said yarn from the remaining untwisted portion of said previously spun yarn, and said rear end portion is removed from said triangular space before or during the supply of fibers to said triangular space.

In that process the spinning apparatus itself is used to provide a previously spun yarn placed into the triangular space between two twisting members with a fiber tuft because the twisting members can be used to exert a suitable torque on the yarn. The yarn which has been placed into the triangular space is untwisted by means of the twisting members in a region in which the fiber tuft should be located. When the rear end portion of the yarn has been detached from the remaining untwisted portion of the yarn, the latter has a fiber tuft which is disposed in the region in which fibers are supplied to the triangular space. When fibers are subsequently supplied to the triangular space said fibers can be twisted together to form a yarn which is joined to the previously spun yarn at its fiber tuft. Because the fiber tuft is formed in the triangular space and the density of fibers in the fiber tuft and the density of fibers twisted together with said fiber tuft vary in inverse relation to each other, the quantity of fibers per unit of length in the joint between the previously spun and newly spun yarns will be constant and the fibers supplied to the triangular space will be joined to the fiber tuft in a satisfactory manner, which ensures that the resulting joint will have the desired strength. As a result, the joint thus formed will not differ from the remaining yarn portions in strength or appearance.

In order to ensure that the fiber tuft will be formed in that the rear end portion of the previously spun yarn is detached from the remaining untwisted portion of said yarn when the latter is tensioned, the previously spun yarn is to be untwisted in a length which is at least as large as the maximum length of the staple fibers contained in said yarn. In that case it will be ensured that no fiber will remain anchored in the rear end portion which is to be detached as well as in the yarn which is to be provided with the fiber tuft and but each fiber in the untwisted yarn portion will be anchored only in the rear end portion or in the main portion of the yarn so that said rear end portion can be pulled off as said fibers are in sliding contact with each other in the untwisted portion of the yarn. It will be understood that said previously spun yarn must be untwisted at least to such a degree that its fibers in the untwisted portion are in sliding contact with each other.

In a particularly desirable embodiment of the invention the previously spun yarn which has been placed into the triangular space is held against rotation at locations beyond opposite ends of the region in which fibers are supplied to that triangular space so that said yarn will not be rotated at said locations by said twisting members but will be untwisted between said locations by said twisting members during a suitable rotation of the latter. In that case the rotation of the two twisting members in the twisting sense that false twist will assist the twisting of the previously spun yarn between the fiber tuft and the gripper which is nearer to the withdrawing means. When the rear end portion of the previously spun yarn has been detached, the false-twisted yarn portion leading the fiber tuft will tend to twist the untwisted fiber tuft and will thus assist the twisting of the fibers which are supplied to the triangular space and joined to the fiber tuft.

In order to ensure that the untwisting of the previously spun yarn in a portion leading its rear end portion will not be adversely affected by a formation of loops in the yarn, a further feature of the invention in that the previously spun yarn is tensioned in said triangular space at least as it is untwisted.

The placing of the previously spun yarn into the triangular space between the two twisting members can most simply be effected if the rotation of the twisting members and/or the sucking of air from said triangular space through said twisting members are discontinued for the time in which said previously spun yarn is being introduced into said space. When the means for driving the twisting members have been shut down, no twisting torque can be exerted on the yarn as it is introduced and the yarn will not be drawn toward the nip between the twisting members because air is not sucked from the triangular space through the twisting members. In that case the yarn can be introduced into the triangular space by suction exerted on the yarn from a location which is at that end of said triangular space that is opposite to the withdrawing means. If the yarn is to be introduced into the triangular space while the twisting members are rotating, the sucking of air from the triangular space through the twisting members should be discontinued so that the yarn can be introduced at a distance from the two twisting members and outside the line along which the new yarn is to be formed. It will be understood that the twisting members must not be rotated during the introduction of the previously spun yarn when air is sucked from said triangular space through the twisting members at the same time.

The rear end portion of the previously spun yarn can desirably be detached from the remaining untwisted portion of said yarn at a time when individual fibers are supplied to the triangular space because the remaining portion of the previously spun yarn must be withdrawn as the newly supplied fibers are twisted in contact with the fiber tuft. In that case there is no need to detach the rear end portion of the previously spun yarn in a separate operation and said rear end portion which has been pulled off can be removed from the triangular space in a direction which is opposite to the direction in which the yarn is withdrawn.

The spinning process described hereinbefore may be carried out in friction spinning apparatus comprising two juxtaposed, closely spaced apart twisting members, which define a triangular space, which tapers toward a nip, wherein at least one of said twisting members contains a suction insert having a suction zone which faces the triangular space, also comprising means for supplying singled fibers to said triangular space, withdrawing means for withdrawing spun yarn from said triangular space at one end thereof, and inserting means for inserting a previously spun yarn into the triangular space from said one end thereof. In accordance with the invention that friction spinning apparatus is characterized in that a yarn brake is provided at the other end of said triangular space and operable to hold said previously spun yarn introduced into said triangular space against rotation at said brake. When the previously spun yarn has been inserted into the triangular space by the inserting means to such an extent that the yarn can be gripped by the yarn brake and the yarn is held against rotation at one location by the yarn brake and at a second location, spaced from said yarn brake, by the withdrawing means or by a separate gripper, the previously spun yarn is untwisted in that condition between and by the twisting members, which are driven for this purpose in an untwisting sense. That untwisting is effected in a yarn portion which extends to the yarn brake. On the other hand, another yarn portion, which extends to the yarn gripping means disposed near the end of said space which is opposite to the yarn brake, will be overtwisted. When the end piece of the yarn is separated, e.g., in that the remaining untwisted portion of the previously spun yarn is withdrawn by the withdrawing means, that overtwist will exert an additional twisting torque on the previously untwisted fibers of the fiber tuft so that the twisting of the new fibers supplied to the triangular space and contacting the fiber tuft will be promoted.

DETAILED DESCRIPTION OF THE PREFERRED EMBODIMENTS

Figure 1:
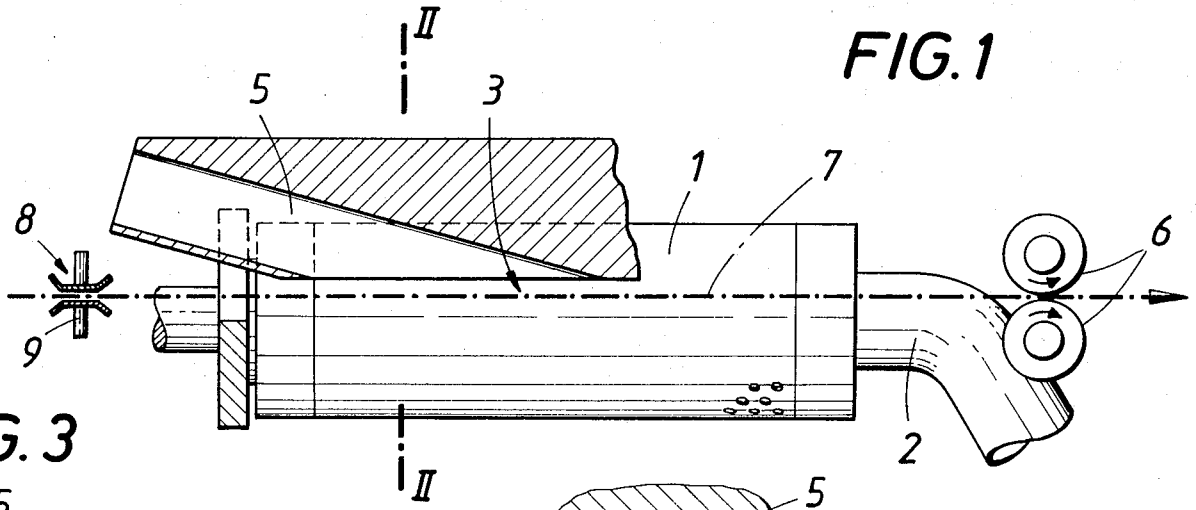
FIG. 1 is a simplified longitudinal sectional view taken on a plane extending through the triangular space between the twisting members of friction spinning apparatus used to spin a yarn joined to a previously spun yarn.
Figure 2:
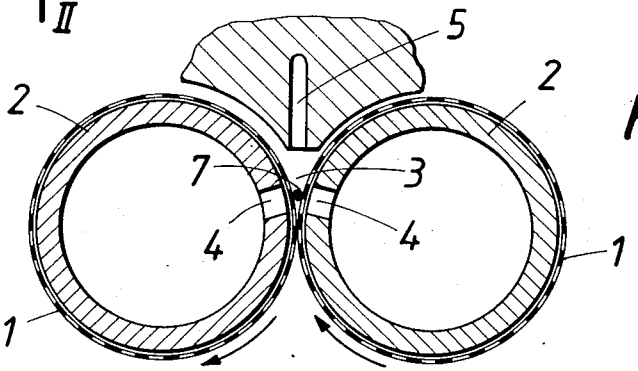
FIG. 2 is an enlarged sectional view taken on line II—II in FIG. 1.

Apparatus designed in accordance with the invention and adapted to carry out the process in accordance with the invention is shown by way of example and in simplified views in the drawing.

The apparatus shown on the drawing comprises two juxtaposed, closely spaced apart twisting members 1, which consist of respective suction drums and each of which comprises a suction insert 2 having an axially extending suction slot 4, which faces the triangular space 3 defined by said drums. A fiber-guiding duct 5 protrudes into the triangular space 3 between the twisting members 1 and is adapted to guide individual staple fibers to said triangular space 3 from a fiber disintegrator, in which said fibers are singled and which is not shown for the sake of clearness. Said fibers are to be twisted together to form a spun yarn. The yarn formed from the singled fibers which have been twisted together in the triangular space 3 between the twisting members 1 is withdrawn by a withdrawing device 6, which comprises two rollers, and said yarn is subsequently wound up.

When it is desired to spin a yarn joined to a previously spun yarn e.g., after a yarn breakage, the previously spun yarn is pulled back into the triangular space 3. For this purpose the withdrawing device 6 can be operated in a reverse sense. When the previously spun yarn 7 has been introduced into the triangular space 3 it is pulled back as far as to a yarn brake 8, which is disposed near the end of the triangular space 3 that is opposite to the withdrawing device 6. The yarn 7 is then held against rotation by the yarn brake 8 and by the withdrawing device 6. The twisting members 1 are subsequently driven to rotate in a sense in which the previously spun yarn is untwisted in a portion extending to the yarn brake 8 and is given an additional twist in a portion extending to the withdrawing device 6. As the yarn is untwisted, the coherence between its fibers is decreased until the fibers are in sliding contact with each other. When the yarn is then tensional as it is withdrawn by the withdrawing device 6 in the direction indicated by an arrow in FIG. 1, untwisted yarn will be detached from the rear end portion held by the yarn brake 8, and will be formed at its newly formed rear end with a thinned-out, untwisted fiber tuft, which tapers rearwardly. When the rear end portion is detached at a time in which singled fibers are supplied through the fiber-guiding duct 5 to the triangular space 3, said singled fibers will contact the fiber tuft as it is formed and said fibers will be twisted together with said fiber tuft if the twisting members 1 are rotated at that time in a twisting sense and air is sucked from the triangular space 3 through the twisting members 1 near their nip at the same time. The resulting joint formed between the previously spun yarn and the newly spun yarn will not differ from said yarns in appearance or strength. For that purpose it is essential that the fiber density of the fiber tuft decreases in a rearward direction and the density of the new fibers supplied by the fiber-guiding duct 5 and joined to the fiber tuft decreases toward the withdrawing device 6 so that the joint including the fiber tuft will contain fibers in a uniform quantity per unit of length.

Figure 3:
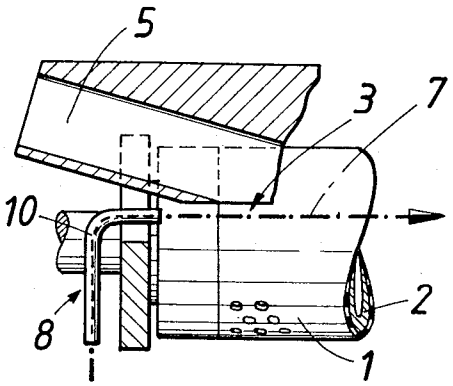
FIG. 3 is a view that is similar to FIG. 1 and shows a modification.

In accordance with FIG. 1 the yarn brake 8 consists of a yarn gripper 9, which is movable relative to the twisting members 1 in the longitudinal direction of the nip defined by them so that the yarn gripper 9 can be moved away from the twisting members 1 in order to remove the rear end portion of the previously spun yarn 7 from the triangular space 3 when said rear end portion has been detached. In accordance with FIG. 3 the yarn brake 8 consists of a suction pipe 10, into which the previously spun yarn 7 is sucked so that it is introduced into the triangular space 3. The suction pipe 10 has a bend and the previously spun yarn 7 introduced into the triangular space 3 and into the suction pipe 10 is forced against the wall of said suction pipe in said bend in frictional contact therewith so that a pulling of said yarn out of said suction pipe into the triangular space 3 and a rotation of said yarn 7 in contact with said suction pipe will be prevented. The suction pipe 10 can also cooperate with the withdrawing device 6 to tension the yarn 7 as it is untwisted.

During the formation of the joint between a previously spun yarn and a newly spun yarn, the peripheral velocity of the twisting members 1, the velocity at which the yarn is withdrawn and the rate at which fibers are supplied may be different individually or in combination, from the values of said parameters during the subsequent spinning of the yarn.

I claim:

1. In a process of spinning a staple fiber yarn joined to a previously spun staple fiber yarn comprising providing two juxtaposed solids of revolution having peripheral surfaces which define an elongate nip and a generally triangular space tapering to said nip, providing in a predetermined region of said triangular space a joint-forming portion of said previously spun yarn extending into said triangular space from one end thereof, sucking air from said triangular space near said nip in said predetermined region, rotating said solids of revolution in a first sense, supplying singled staple fibers to said triangular space in said predetermined region so that said fibers contact said joint-forming portion, and withdrawing said previously spun yarn from said triangular space at said one end thereof, said sucking, rotating, supplying and withdrawing being performed at the same time so that said fibers are twisted together to form a newly spun yarn joined to said joint-forming portion, the improvement residing in that said previously spun yarn is placed into said trianglar space so that a rear end portion of said previously spun yarn protrudes from said triangular space at the other end thereof, said previously spun yarn is untwisted in said predetermined region to form an untwisted portion, said previously spun yarn is tensioned to detach, said rear end portion from said untwisted portion to form the latter in said predetermined region with a thinned-out, untwisted fiber tuft, which constitutes said joint-forming portion, and said rear end portion is removed from said triangular space.

2. The improvement set forth in claim 1, wherein said rear end portion is removed from said triangular space before said sucking, rotating, supplying and withdrawing are performed at the same time.

3. The improvement set forth in claim 1, wherein said rear end portion is removed from said triangular space while said sucking, rotating, supplying and withdrawing are performed at the same time.

4. The improvement set forth in claim 3, wherein said rear end portion is detached from said untwisted portion in that said rear end portion is fixed and said sucking, rotating, supplying and withdrawing operations are performed at the same time.

5. The improvement set forth in claim 1, wherein said end portion is detached from said untwisted portion in that said rear end portion is fixed and said previously spun yarn is withdrawn from said triangular space at said one end thereof.

6. The improvement set forth in claim 1, wherein said previously spun yarn is untwisted in said predetermined region in that said solids of revolution are rotated in a second sense, which is opposite to said first sense.

7. The improvement set forth in claim 6, wherein said previously spun yarn extends through said triangular space and held against rotation at two locations beyond respective ends of said predetermined region.

8. The improvement set forth in claim 1, wherein said previously spun yarn is tensioned as it is untwisted in said predetermined region.

9. The improvement set forth in claim 1, wherein said previously spun yarn is introduced into said triangular space when said solids of revolution are not driven to rotate.

10. The improvement set forth in claim 1 as applied to a process in which said sucking comprises a sucking of air from said triangular space at said nip through at least one of said solids of revolution, wherein said previously spun yarn is introduced into said triangular space when no air is sucked from said triangular space near said nip through said at least one solid of revolution.

11. In apparatus for spinning a staple fiber yarn joined to a previously spun staple fiber yarn, comprising two juxtaposed twisting members, which constitute respective solids of revolution having peripheral surfaces which define an elongate nip and a generally triangular space tapering to said nip, sucking means for sucking air from said triangular space near said nip in said predetermined region, drive means for rotating said twisting members in at least one sense, which is the same for both twisting members, supplying means for supplying singled staple fibers to said triangular space in a predetermined region thereof, withdrawing means for withdrawing yarn from said triangular space at one end thereof, and inserting means for introducing a previously spun staple fiber yarn into said triangular space from said one end thereof so that a joint-forming portion of said yarn is disposed in said predetermined region, the improvement residing in that said drive means are operable to rotate said twisting member in two mutually opposite senses, which are the same for both twisting members, said withdrawing means are adapted to hold said yarn against rotation and a yarn brake which is adapted to hold a rear end portion of said previously spun yarn against rotation is provided near the other end of said triangular space.

12. The improvement set forth in claim 11, wherein said inserting means comprise additional sucking means for winding air from said triangular space at said opposite end thereof.

13. The improvement set forth in claim 12, wherein said yarn brake comprises a curved pipe and said additional sucking means are connected to said curved pipe.

14. In a process of spinning a staple fiber yarn joined to a previously spun staple fiber yarn having an end portion, comprising untwisting said previously spun yarn to form it with an untwisted portion spaced from the extreme end of said end portion, tensioning said previously spun yarn to detach said end portion from said untwisted portion to form the latter with a thinned-out, untwisted fiber tuft, contacting said fiber tuft with singled staple fibers in a predetermined region, and jointly twisting said fiber tuft and said individual fibers contacting said fiber tuft in said predetermined region and simultaneously withdrawing said previously spun yarn from said predetermined region at one end thereof so that said individual fibers are spun to form a yarn joined to said previously spun yarn, the improvement residing in that said previously spun yarn is placed to extend through said predetermined region so that said end portion protrudes from said predetermined region at the other end thereof, said previously spun yarn is untwisted in said predetermined region while said previously spun yarn is held against rotation at two locations disposed beyond respective ends of said predetermined region, and said previously spun yarn is tensioned to detach said end portion from said unteisted portion when the latter extends in said predetermined region so that said fiber tuft is formed in said predetermined region.

15. Apparatus for spinning a staple fiber yarn joined to a previously spun staple fiber yarn, comprising means for contacting a fiber tuft provided at one end of a previously spun yarn with singled staple fibers in a predetermined region, means for jointly twisting said fiber tuft and said singled fibers contacting said fiber tuft in said predetermined region, and means for withdrawing said previously spun yarn from said predetermined region at one end thereof so that said singled fibers twisted jointly with said fiber tuft are spun to form a yarn joined to said previously spun yarn, the improvement residing in that inserting means are provided for placing said previously spun yarn so that it extends through said predetermined region and said end portion protrudes from said predetermined region at the other end thereof, retaining means are provided for holding said previously spun yarn extending through said predetermined region against rotation at two locations disposed beyond respective ends of said predetermined region, said twisting means are operable to untwist said previously spun yarn in said predetermined region, and said retaining means comprise a yarn brake arranged beyond said other end of said predetermined region.

* * * * *